US009242161B2

(12) United States Patent
Seacat et al.

(10) Patent No.: US 9,242,161 B2
(45) Date of Patent: Jan. 26, 2016

(54) ACCURACY AND EXPERIENCE OF GAME BY ACTIVATING APPROPRIATE LIGHT-EMITTING FIBERS INTERTWINED IN GRASS RELATED TO A GAME OBJECT OR PLAYER ENTERING OR LEAVING A HOT ZONE AREA

(75) Inventors: Lisa Anne Seacat, San Francisco, CA (US); Travis M. Grigsby, Austin, TX (US); Steven Michael Miller, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 2673 days.

(21) Appl. No.: 11/832,351

(22) Filed: Aug. 1, 2007

(65) Prior Publication Data

US 2009/0036205 A1 Feb. 5, 2009

(51) Int. Cl.
*A63B 69/00* (2006.01)
*A63B 71/06* (2006.01)

(52) U.S. Cl.
CPC ..... *A63B 69/002* (2013.01); *A63B 69/0024* (2013.01); *A63B 69/0071* (2013.01); *A63B 71/0605* (2013.01); *A63B 2071/0641* (2013.01); *A63B 2207/00* (2013.01); *A63B 2225/50* (2013.01)

(58) Field of Classification Search
USPC ..... 385/147
See application file for complete search history.

(56) References Cited

U.S. PATENT DOCUMENTS 6,950,599 B2 * 9/2005 Nicholls et al. ..... 385/147
7,369,038 B1 * 5/2008 Thompson ..... 340/323 R
2006/0180647 A1 * 8/2006 Hansen ..... 235/375

FOREIGN PATENT DOCUMENTS

JP 2006040052 2/2006
JP 2006-040052 A * 9/2006 ..... G06K 17/00

OTHER PUBLICATIONS

Peter Evans, Ontario company uses fibre optics to turns turf into giant displays, Globe and Mail, Mar. 13, 2007, http://www.theglobeandmail.com/report-on-business/article746370.ece.*
"Top Secret Sportexe Sci-fi Synthetic Leaks—Word's Out!,"http://www.omnigrass.com/turf_news_turf_tv.htm; Sportexe 2007.
Burke, Monte, "Field of Screens," http://www.forbes.com/forbes/2006/1127/058_print.html, forbes.com, Nov. 27, 2006.

* cited by examiner

*Primary Examiner* — Paul A D'Agostino
*Assistant Examiner* — Jason Yen
(74) *Attorney, Agent, or Firm* — Winstead, P.C.

(57) ABSTRACT

A method, system and computer program product for improving accuracy and experience of a game. Hot zone areas are determined using game rules. "Hot zone areas" are areas on the playing field where a call may be made based on the rules of the game. Signals are sent from a computer system to appropriate sensors to activate connected light-emitting fibers that are blended with grass on the playing field to indicate when a player and/or game object enters or exits a hot zone area. The light-emitting fibers are activated in such a manner as to display an image (e.g., footprint) indicating the entrance/exiting of a player and/or game object in/from a hot zone area (e.g., out of bounds line) thereby ensuring the game is fair and accurate and enhancing the experience of the game.

17 Claims, 4 Drawing Sheets

ACCURACY AND EXPERIENCE OF GAME BY ACTIVATING APPROPRIATE LIGHT-EMITTING FIBERS INTERTWINED IN GRASS RELATED TO A GAME OBJECT OR PLAYER ENTERING OR LEAVING A HOT ZONE AREA

CROSS REFERENCE TO RELATED APPLICATIONS

The present invention is related to the following U.S. patent application which is incorporated herein by reference:

Ser. No. 11/832,336 entitled "Improving Accuracy and Experience of Game by Activating Appropriate Light-Emitting Fibers Intertwined in Grass Related to a Player's or Game Object's Position" filed Aug. 1, 2007.

TECHNICAL FIELD

The present invention relates to the field of sports, and more particularly to improving the accuracy and experience of a game by activating appropriate light-emitting fibers that are intertwined in grass on a playing field in order to display an indication (e.g., footprints of a player) on the field when a game object (e.g., football) or player enters or leaves a hot zone area (e.g., out of bounds, offside line, goalie box).

BACKGROUND INFORMATION

Sports is an activity that is governed by a set of rules or customs and often engaged in competitively. Sports commonly refers to activities where the physical capabilities of the competitor are the sole or primary determiner of the outcome (winning or losing), but the term is also used to include activities such as mind sports and motor sports where mental acuity or equipment quality are major factors. Sports are used as entertainment for the player and the viewer. It has also been proven by experiments that daily exercise increases mental strength and power to study.

Technology is playing an important role in sports, whether applied to an athlete's health, the athlete's technique, equipment's characteristics or even ensuring a fair game. For example, a system referred to as "instant replay" has been implemented in several sports (e.g., football, hockey, college football, basketball, tennis, rugby, etc.) where plays in a sporting match can be reviewed (or replayed) using recorded video feeds of the sporting match in order to ensure that the correct call is made on the play. However, instant replay is usually limited to being used in certain situations. For example, goals in hockey can only be reviewed in the following situations: puck crossing the goal line completely; puck in the net prior to the end of the period; puck in the net prior to goal frame being dislodged; puck being directed into the net by hand or foot; puck in the net after deflecting directly off an official; and puck deflected into the goal by the high stick by an attacking player. Hence, many calls are still subject to human error. Further, even with instant replay, mistakes may still occur as usually a referee, a replay judge, etc., can only overturn a call if the call is clearly in error. Hence, a call may be incorrect but if there is not enough evidence to show the call to be clearly incorrect, the call will stand.

Recently, a synthetic turf system used on a game field has been developed that includes blades of polyethylene grass blended with light-emitting fibers with the capability of reflecting light upwards. The fiber-optical laden blades are supposed to have the same look, feel and durability as non-illuminated blades. This system is commonly being referred to as "Turf TV" as the fiber-optical blades can be used to display team logos and even commercial viewing.

As technology continues to play an important role in sports, it would be desirable if this fiber optic field technology could be used to ensure the game is even more fair and accurate than under the current system of instant replay thereby enhancing the experience of the game.

SUMMARY

The problems outlined above may at least in part be solved in some embodiments by activating the appropriate light-emitting fibers on the playing field in such a manner as to display an image(s) on the playing field when a player and/or game object (e.g., football) enters or leaves a hot zone area (e.g., goal line, first down line, offside line, goalie box) thereby ensuring the game is fair and accurate and enhancing the experience of the game.

In one embodiment of the present invention, a method for improving accuracy and experience of a game comprises the step of determining hot zone areas according to game rules. The method further comprises sending signals to appropriate sensors to activate appropriate light-emitting fibers blended with grass on a field to indicate when one of a player and a game object entered or exited a hot zone area. The method additionally comprises activating the appropriate light-emitting fibers to give off light.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE DRAWINGS

A better understanding of the present invention can be obtained when the following detailed description is considered in conjunction with the following drawings, in which.

DETAILED DESCRIPTION

The present invention comprises a method, system and computer program product for improving accuracy and experience of a game. In one embodiment of the present invention, hot zone areas are determined using game rules. Hot zone areas, as used herein, may refer to areas on the playing field where an infraction (e.g., offsides in soccer), successful play (e.g., first down line) or a game ending play (e.g., side line in football) may occur. In other words, "hot zone areas" are areas on the playing field where a call may be made based on the rules of the game. Signals are sent from a computer system to appropriate sensors to activate connected light-emitting fibers that are blended with grass on a playing field to indicate when a player and/or game object enters or exits a hot zone area. The light-emitting fibers are activated in such a manner as to display an image (e.g., footprint) indicating the entrance/exiting of a player and/or game object in/from the hot zone area (e.g., out of bounds line) thereby ensuring the game is fair and accurate and enhancing the experience of the game.

While the following discusses the present invention in connection with sports, the principles of the present invention may be applied to other events, such as half-time shows for a band or a dance team. The principles of the present invention may be applied to any event that uses a field. Further, a person of ordinary skill in the art would be capable of applying the principles of the present invention to any event that uses a playing field. Further, embodiments covering such permutations would fall within the scope of the present invention.

In the following description, numerous specific details are set forth to provide a thorough understanding of the present invention. However, it will be apparent to those skilled in the art that the present invention may be practiced without such specific details. In other instances, well-known circuits have been shown in block diagram form in order not to obscure the present invention in unnecessary detail. For the most part, details considering timing considerations and the like have been omitted inasmuch as such details are not necessary to obtain a complete understanding of the present invention and are within the skills of persons of ordinary skill in the relevant art.

Figure 1A:
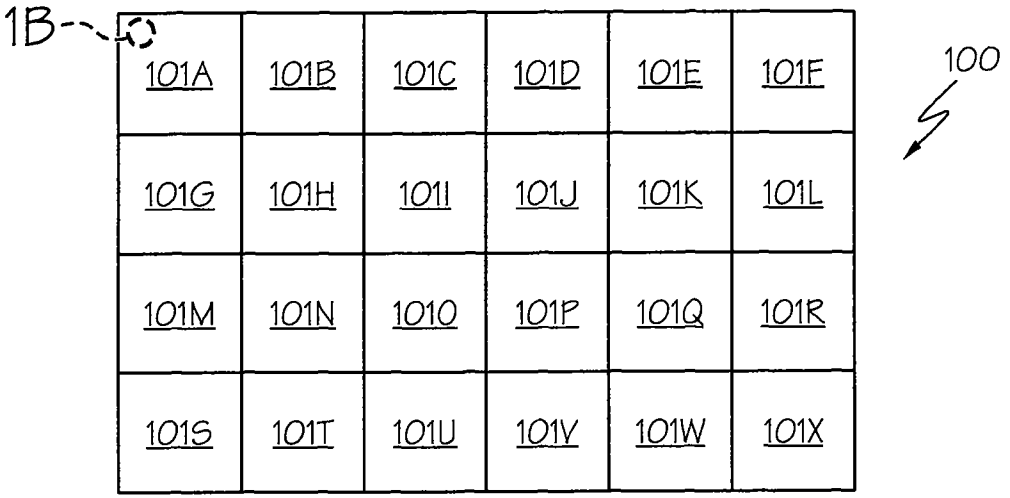
FIGS. 1A-B illustrate a game field incorporating optical field technology in accordance with an embodiment of the present invention.
Figure 1B:
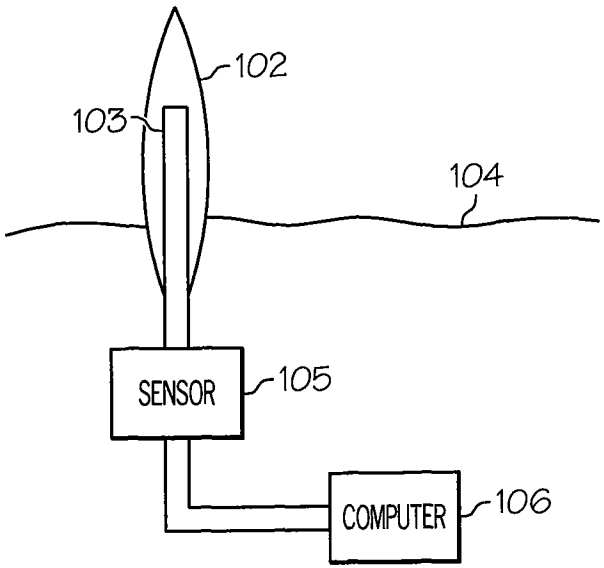

FIGS. 1A-B—Game Field Implementing Grass Blended with Fiber Optic Blades

FIG. 1A illustrates an embodiment of the present invention of a game playing field 100 (e.g., soccer field, football field) where field 100 is divided into "trays" 101A-X that may be square shaped. Trays 101A-X may collectively or individually be referred to as trays 101 or tray 101, respectively. It is noted that trays 101 may be configured in a different shape than a square and that FIG. 1A is illustrative. Further, field 100 may include any number of trays 101 (e.g., 1,750 trays) that are interconnected with each other. Each tray 101 may include thousands of blades of grass 102 (e.g., polyethylene grass), blended with light-emitting fibers 103 (e.g., optical fibers), that reflect light upwards from tray 101 as illustrated in FIG. 1B.

FIG. 1B illustrates one of the thousands of blades of grass 102 in tray 101 in accordance with an embodiment of the present invention. Referring to FIG. 1B, each blade of grass 102 may be positioned in or on the soil 104 or other material. A portion of or all of the thousands of blades of grass 102 in tray 101 may each be blended with a light-emitting fiber 103. Light-emitting fiber 103 may be connected to a sensor 105 configured to detect the obscuring of light thereby indicating the movement of a ball or a player passing light-emitting fiber 103. Sensor 105 may further be configured to activate the connected light-emitting fiber 103 thereby allowing light-emitting fiber 103 to provide light of a certain color (including white light). Each sensor 105 may be connected to a computer 106 configured to control the activation of light-emitting fibers 103 in each tray 101 in field 100 as discussed further below in connection with FIGS. 3-4. A more detail discussion of computer system 106 is provided below in connection with FIG. 2.

Figure 2:
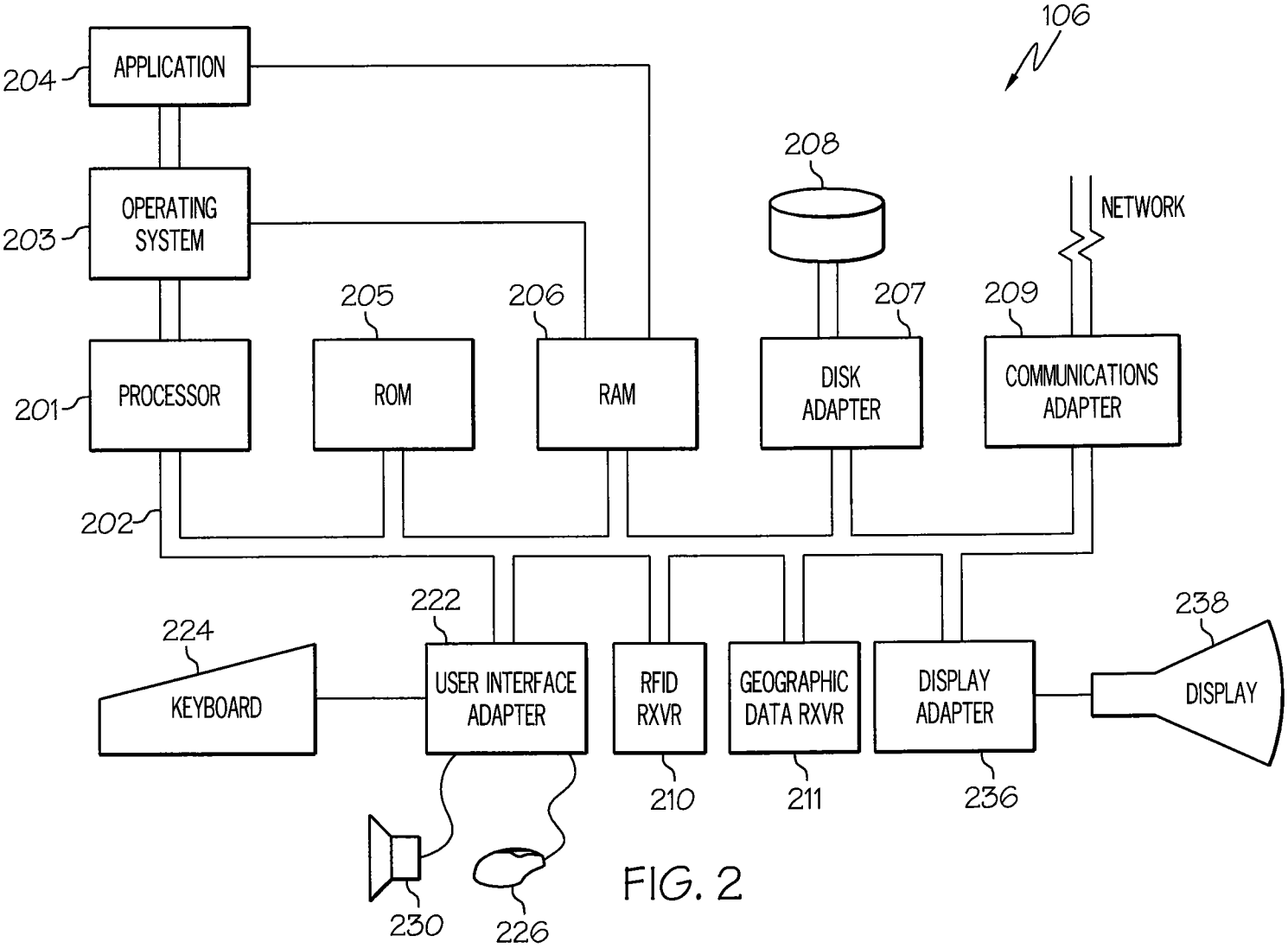
FIG. 2 illustrates a hardware configuration of a computer system in accordance with an embodiment of the present invention.

FIG. 2—Computer System

FIG. 2 illustrates an embodiment of a hardware configuration of computer system 106 (FIG. 1B) which is representative of a hardware environment for practicing the present invention. Computer system 106 may have a processor 201 coupled to various other components by system bus 202. An operating system 203 may run on processor 201 and provide control and coordinate the functions of the various components of FIG. 2. An application 204 in accordance with the principles of the present invention may run in conjunction with operating system 203 and provide calls to operating system 203 where the calls implement the various functions or services to be performed by application 204. Application 204 may include, for example, a program for improving the accuracy and experience of a game by implementing fiber optic field technology as discussed further below in association with FIGS. 3-4.

Referring to FIG. 2, read-only memory ("ROM") 205 may be coupled to system bus 202 and include a basic input/output system ("BIOS") that controls certain basic functions of computer system 106. Random access memory ("RAM") 206 and disk adapter 207 may also be coupled to system bus 202. It should be noted that software components including operating system 203 and application 204 may be loaded into RAM 206, which may be computer system's 106 main memory for execution. Disk adapter 207 may be an integrated drive electronics ("IDE") adapter that communicates with a disk unit 208, e.g., disk drive. It is noted that the program for improving the accuracy and experience of a game by implementing fiber optic field technology, as discussed further below in association with FIGS. 3-4, may reside in disk unit 208 or in application 204.

Referring to FIG. 2, computer system 106 may further include a communications adapter 209 coupled to bus 202. Communications adapter 209 may interconnect bus 202 with a network (e.g., local area network ("LAN"), wide area network ("WAN")) to allow computer system 106 to communicate with sensors 105 (FIG. 1B).

Computer system 106 may further include a radio frequency identification receiver 210 (indicated as "RFID RXVR" in FIG. 2) configured to receive data sent from a radio frequency identification ("RFID") chip or tag that may be placed on an object (e.g., soccer ball), on a player or in a player's equipment (e.g., football helmet, player's shoe). The RFID chip or tag stores data that may be thought of as an "electronic label" or a "code plate" that uniquely identifies items or players. Hence, upon RFID RXVR 210 receiving radio frequency identification tag data, application 204 may be configured to read the tag data and determine the object (e.g., soccer ball) or player (e.g., Joe Smith) associated with the tag data.

In connection with receiving the tag data, computer system 106 may further receive geographic information via a geographic data receiver 211 (indicated as "Geographic Data RXVR" in FIG. 2). The geographic information may include global positioning system ("GPS") data from a GPS receiver which may be placed inside a ball (e.g., football, soccer ball) or on a player or in a player's equipment (e.g., football helmet, player's shoe). As is commonly known in the art, the GPS receiver uses triangulation to determine its location. The GPS receiver may relay position data to geographic data receiver 211, such as by using the NMEA 0183 protocol. Upon receiving the position data along with the tag data, computer system 106 is able to determine the position of the ball or the identified player on field 100 (FIG. 1A).

Referring to FIG. 2, input/output ("I/O") devices may also be connected to computer system 106 via a user interface adapter 222 and a display adapter 236. Keyboard 224, mouse 226 and speaker 230 may all be interconnected to bus 202 through user interface adapter 222. Data may be inputted to computer system 106 through any of these devices. A display monitor 238 may be connected to system bus 202 by display adapter 236. In this manner, a user is capable of inputting to computer system 106 through keyboard 224 or mouse 226 and receiving output from computer system 106 via display 238 or speaker 230.

The various aspects, features, embodiments or implementations of the invention described herein can be used alone or in various combinations. The methods of the present invention can be implemented by software, hardware or a combination of hardware and software. The present invention can also be embodied as computer readable code on a computer readable medium. The computer readable medium is any data storage device that can store data which can thereafter be read by a computer system. Examples of the computer readable medium include read-only memory, random access memory, CD-ROMs, flash memory cards, DVDs, magnetic tape, optical data storage devices, and carrier waves. The computer readable medium can also be distributed over network-coupled computer systems so that the computer readable code is stored and executed in a distributed fashion.

Figure 3:
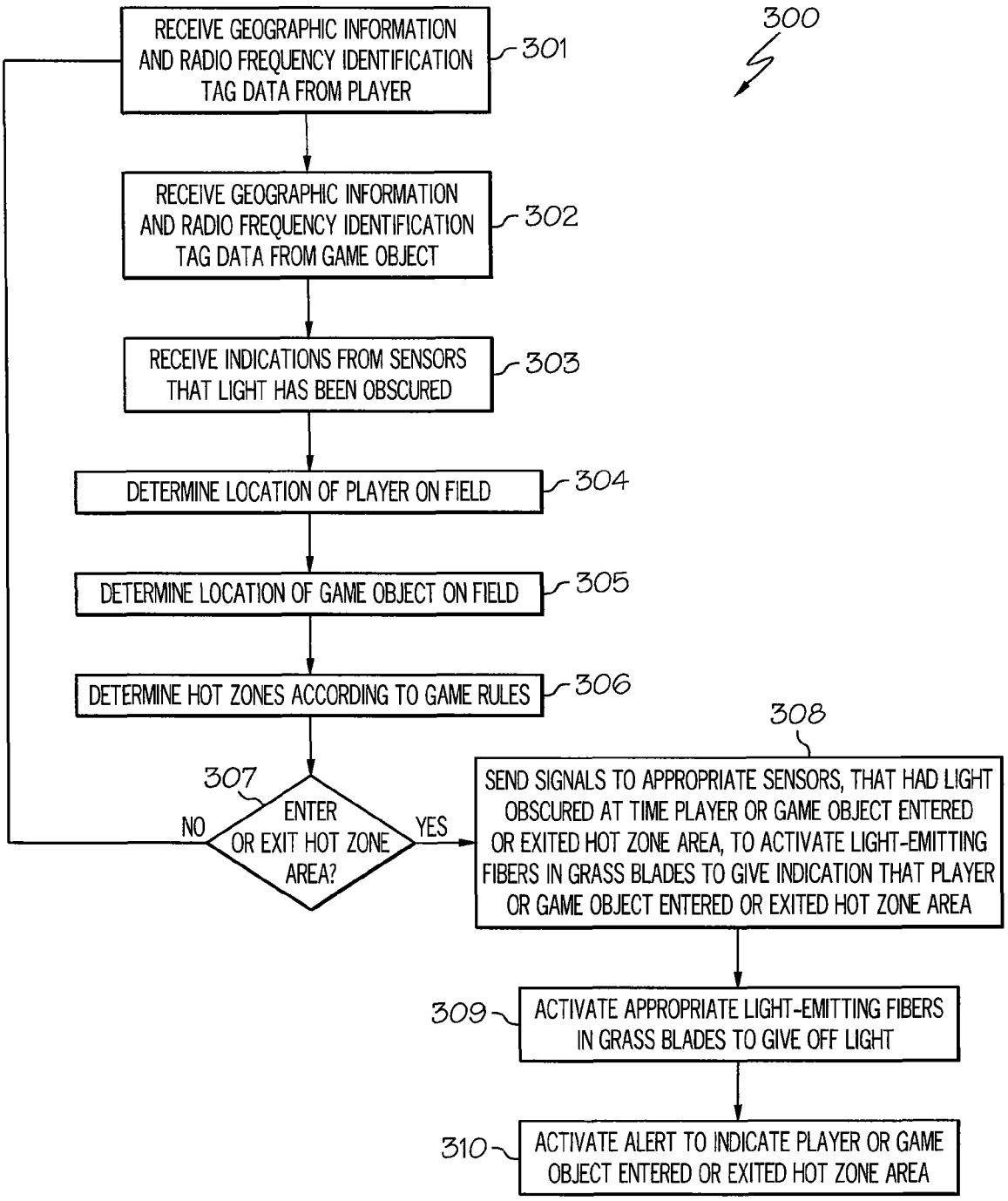
FIG. 3 is a flowchart of a method for indicating when a player and/or game object enters or exits a hot zone area in accordance with an embodiment of the present invention.
Figure 4:
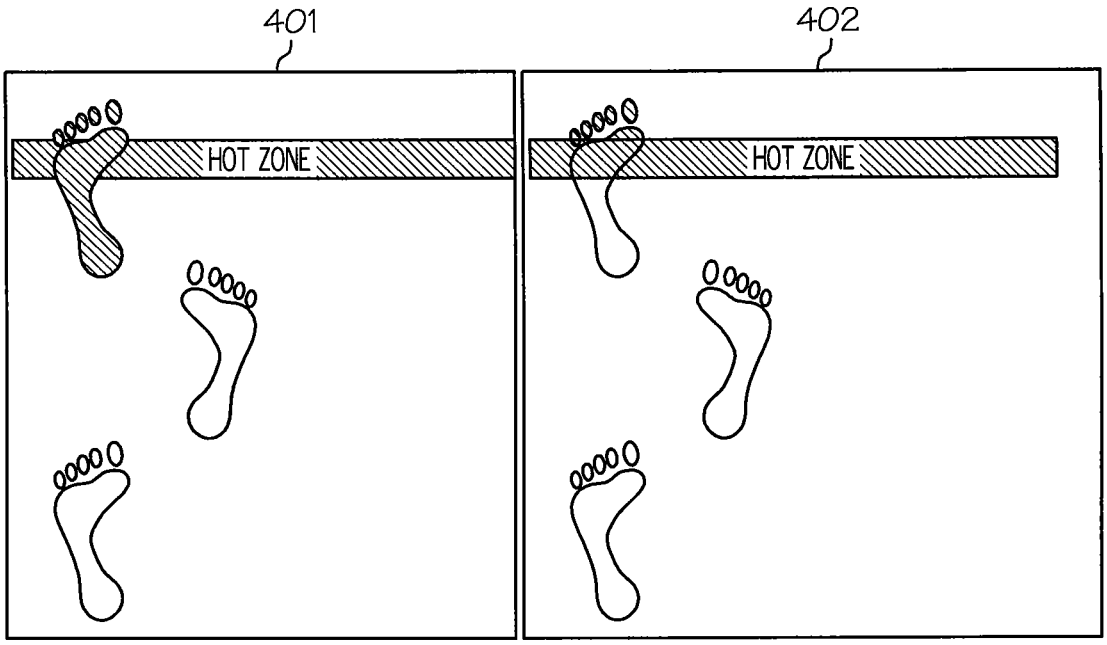
FIG. 4 illustrates displaying on the playing field the footprints of a player entering the hot zone area in accordance with an embodiment of the present invention.

As stated in the Background Information section, technology is playing an important role in sports, whether applied to an athlete's health, the athlete's technique, equipment's characteristics or even ensuring a fair game. For example, a system referred to as "instant replay" has been implemented in several sports (e.g., football, hockey, college football, basketball, tennis, rugby, etc.) where plays in a sporting match can be reviewed (or replayed) using recorded video feeds of the sporting match in order to ensure that the correct call is made on the play. However, instant replay is usually limited to being used in certain situations. Hence, many calls are still subject to human error. Further, even with instant replay, mistakes may still occur as usually a referee, a replay judge, etc., can only overturn a call if the call is clearly in error. Hence, a call may be incorrect but if there is not enough evidence to show the call to be clearly incorrect, the call will stand. Recently, a synthetic turf system used on a game field has been developed that includes blades of polyethylene grass blended with light-emitting fibers with the capability of reflecting light upwards. The fiber-optical laden blades are supposed to have the same look, feel and durability as non-illuminated blades. This system is commonly being referred to as "Turf TV" as the fiber-optical blades can be used to display team logos and even commercial viewing. As technology continues to play an important role in sports, it would be desirable if this fiber optic field technology could be used to ensure the game is even more fair and accurate than under the current system of instant replay thereby enhancing the experience of the game. The fiber optic field technology, as discussed in connection with FIGS. 1A-B, is used to ensure the game is more fair and accurate than the current system of instant replay as discussed further below in connection with FIGS. 3-4. FIG. 3 is a flowchart of a method for indicating on the field when a player and/or game object enters or leaves a "hot zone area" (discussed further below) and providing an indication on the field to highlight the actions of the play or game object in the hot zone area. FIG. 4 illustrates displaying on the field the footprints of a player entering the hot zone area.

FIG. 3—Method for Indicating when a Player and/or Game Object Enters or Exits a Hot Zone Area FIG. 3 is a method 300 for indicating when a player and/or game object (e.g., soccer ball) enters or exits a hot zone area (e.g., out of bounds, offside line) in accordance with an embodiment of the present invention.

Referring to FIG. 3, in conjunction with FIGS. 1-2, in step 301, computer system 106 receives geographic information and radio frequency identification tag data from a player on field 100. For example, the player's equipment (e.g., helmet, shoe) may be equipped with both a global positioning system receiver and a radio frequency tag. Both the global positioning system receiver and the radio frequency tag may be configured to transmit geographic and radio frequency identification tag data, respectively, to computer system 106.

In step 302, computer system 106 receives geographic information and radio frequency identification tag data from a ball on field 100. For example, a football may be equipped with both a global positioning system receiver and a radio frequency tag. Both the global positioning system receiver and the radio frequency tag may be configured to transmit geographic and radio frequency identification tag data, respectively, to computer system 106.

In step 303, computer system 106 further receives indications from sensors 105 that light has been obscured. Light may be obscured when a player or game object moves over glass blade 102 blended with light-emitting fiber 103. For example, suppose a shoe of a player passed over a section of field 100. Sensors 105 detect the obscuring of light under the shoe as the player moves along field 100. Computer system 106 may receive these indications to more accurately determine the position of the player or game object. As stated above, computer system 106 receives geographic information and radio frequency identification tag data from a player and game object in steps 301, 302, respectively. The geographic information provides information as to the location of the player or game object where the player or game object is identified by the received radio frequency identification tag data. However, in order to improve the accuracy of the location of the player and/or game object, computer system 106 may receive information from sensors 105 that indicates the obscuring of light. Computer system 106 may correlate the information from sensors 105 with the received geographic information and radio frequency identification tag data thereby more accurately determining the location of the player and/or game object. For example, computer system 106 may determine that the pattern resulting from the obscuring of light from a particular set of sensors 105 corresponds to the footprint of a particular player.

In step 304, computer system 106 determines the location of the player on field 100 based on the geographic information and radio frequency identification tag data received from the player in step 301 as well as based on the received indications from sensor 105 in step 303.

In step 305, computer system 106 determines the location of the game object (e.g., soccer ball) on field 100 based on the geographic information and radio frequency identification tag data received from the game object in step 302 as well as based on the received indications from sensor 105 in step 303.

In step 306, computer system 106 determines "hot zone areas" according to the game rules. "Hot zone areas," as used herein, may refer to areas on field 100 where an infraction (e.g., offsides in soccer), successful play (e.g., first down line) or a game ending play (e.g., side line in football) may occur. In other words, "hot zone areas" are areas on field 100 where a call may be made based on the rules of the game. Hot zone areas may be dynamic. For example, the offside line in soccer may move in connection with the movement of the defenders.

In step 307, computer system 106 determines whether a player (e.g., goalie) or game object entered or exited a hot zone area (e.g., goalie box). If a player or game object did not enter or leave a hot zone area, then, in step 301, computer system 106 receives additional geographic information and radio frequency identification tag data from a player on field 100.

If, however, a player and/or game object entered or exited a hot zone area, then, in step 308, computer system 106 sends signals to the appropriate sensors 105, that had light obscured at the time a player and/or game object entered or exited a hot zone area, to activate those connected light-emitting fibers 103 in grass blades 102 in a manner that gives an indication that a player and/or game object entered or exited a hot zone area. In step 309, the appropriate light-emitting fibers 103 in grass blades 102 are activated to give off light.

In one embodiment, the appropriate light-emitting fibers 103 are activated in such a manner as to give off light which causes an image to be displayed on field 100. In one embodiment, each player or game object may be associated with a unique image. For example, each player may be associated with a unique set of footprints. These footprints may be stored in a separate database (not shown in any Figures) accessible by computer system 106. Using these unique set of footprints, the activated light-emitting fibers 103 may display images of a set of footprints showing the associated player entering or exiting the hot zone as illustrated in FIG. 4. FIG. 4 illustrates displaying on field 100 the footprints of a player entering the hot zone area in accordance with an embodiment of the present invention.

Referring to FIG. 4, FIG. 4 illustrates a snapshot 401 of a hot zone area (e.g., side line of a football game) depicting images of footprints displayed by the activated light-emitting fibers 103 showing the player entering the hot zone area. In one embodiment, the images of footprints may be displayed in a different color or shade illustrating the entrance of a hot zone area. For example, snapshot 401 illustrates the entire footprint entering the hot zone area having a different shade. In one embodiment, the shading and coloring illuminated by light-emitting fibers 103 may be controlled by sensors 105. Computer system 106 may instruct appropriate sensors 105 to activate light-emitting fibers 103 in a manner to illuminate in a different color than other activated light-emitting fibers 103 thereby highlighting the entrance of the hot zone area. Alternatively, a portion of a footprint may be displayed in a different color or shade illustrating the actual breaching of a hot zone area as illustrated in snapshot 402.

By providing images on field 100 to indicate the entrance/exiting of a player and/or game object (e.g., football) entering/leaving the hot zone area, referees can accurately determine if an infraction, successful play, etc. has occurred thereby ensuring the game is fair and accurate and enhancing the experience of the game.

In one embodiment, the images displayed on field 100 by light-emitting fibers 103 may persist for a specified period of time. In another embodiment, the images displayed on field 100 by light-emitting fibers 103 may remain on field 100 to aid the officials in determining the exact position of the player and/or game object.

In one embodiment, the images displayed on field 100 may correspond to the actual imprint made by the game object and/or player based on the obscuring of light. For example, suppose a shoe of a player passed over a section of field 100. Sensors 105 detect the obscuring of light under the shoe as the player moves along field 100. Sensors 105 that are located in soil 104 under the shoe of the player will then send indications of the obscuring of light to computer system 106 which will then determine the pattern of the shoe of the player based on which sensors 105 sent the indications of the obscuring of light. This pattern may later be used by computer system 106 to activate the appropriate light-emitting fibers 105 so that the image of the actual shoe of the player is used to highlight the entrance of or exiting from a hot zone area.

Further, it is noted that not everything in the hot zone area is necessarily displayed on field 100. Computer system 106 may selectively display via activation of the appropriate light-emitting fibers 103 an image(s) associated with a player(s) and/or a game object to highlight the important aspects related to a call to be made based on the player(s) and/or game object entering or exiting the hot zone area.

Returning to FIG. 3, in addition to displaying an image on field 100 to "highlight" a player and/or game object entering or exiting a hot zone area, computer system 106, in step 310, activates an alert to indicate that a player or game object entered or exited a hot zone area. For example, a noise may be played indicating that a player is offsides. In another example, additional lines may be drawn on field 100 via activating the appropriate light-emitting fibers 103 to "highlight" the entrance of a hot zone area.

While FIG. 3 was discussed in connection with an example of displaying footprints to highlight a player entering or exiting a hot zone area, the principles of the present invention of FIG. 3 may be applied to displaying other images, such as an image of a ball (e.g., football) entering or exiting a hot zone area (e.g., goal line). It is noted that a person of ordinary skill in the art would be capable of applying the principles of the present invention of FIG. 3 to displaying other images, such as an image of a ball (e.g., football) entering or exiting a hot zone area (e.g., goal line). Further, embodiments covering such permutations would fall within the scope of the present invention.

Method 300 may include other and/or additional steps that, for clarity, are not depicted. Further, method 300 may be executed in a different order presented and that the order presented in the discussion of FIG. 3 is illustrative. Additionally, certain steps (e.g., steps 301-303; 304-305) in method 300 may be executed in a substantially simultaneous manner or may be omitted.

Although the method, system and computer program product are described in connection with several embodiments, it is not intended to be limited to the specific forms set forth herein, but on the contrary, it is intended to cover such alternatives, modifications and equivalents, as can be reasonably included within the spirit and scope of the invention as defined by the appended claims. It is noted that the headings are used only for organizational purposes and not meant to limit the scope of the description or claims.

The invention claimed is:

1. A method for improving accuracy and experience of a game comprising the steps of:

determining hot zone areas according to game rules;

sending signals to appropriate sensors to activate appropriate light-emitting fibers blended with grass on a field to indicate when one of a player and a game object entered or exited a hot zone area;

activating said appropriate light-emitting fibers to give off light;

receiving geographic information and radio frequency identification tag data from said game object or from said player; and determining a location of said game object or said player on said field based on said geographic information and said radio frequency identification tag data.

2. The method as recited in claim 1 further comprising the step of:

receiving an indication from said appropriate sensors that light has been obscured.

3. The method as recited in claim 2, wherein said signals are sent to said appropriate sensors that had light obscured at time one of said player and said game object entered or exited said hot zone area.

4. The method as recited in claim 2 further comprising:

determining said location of said game object or said player on said field based on said geographic information and said radio frequency identification tag data as well as based on said indication from said appropriate sensors that light has been obscured.

5. The method as recited in claim 1, wherein said appropriate light-emitting fibers are activated to give off light in such a manner as to provide an image on said field of footprints of said player entering or exiting said hot zone area.

6. The method as recited in claim 5, wherein said footprints remain on said field for a specified period of time.

7. The method as recited in claim 1, wherein said appropriate light-emitting fibers are activated to give off light in such a manner as to provide an image on said field of said game object entering or exiting said hot zone area.

8. The method as recited in claim 1 further comprising the step of:

activating an alert to indicate one of said player and said game object entered or exited said hot zone area.

9. A system, comprising:

a memory unit for storing a computer program for improving accuracy and experience of a game; and a processor coupled to said memory unit, wherein said processor, responsive to said computer program, comprises:

circuitry for determining hot zone areas according to game rules;

circuitry for sending signals to appropriate sensors to activate appropriate light-emitting fibers blended with grass on a field to indicate when one of a player and a game object entered or exited a hot zone area;

circuitry for activating said appropriate light-emitting fibers to give off light;

circuitry for receiving geographic information and radio frequency identification tag data from said game object or from said player; and circuitry for determining a location of said game object or said player on said field based on said geographic information and said radio frequency identification tag data.

10. The system as recited in claim 9, wherein said processor further comprises:

circuitry for receiving an indication from said appropriate sensors that light has been obscured.

11. The system as recited in claim 10, wherein said signals are sent to said appropriate sensors that had light obscured at time one of said player and said game object entered or exited said hot zone area.

12. The system as recited in claim 10, wherein said processor further comprises:

circuitry for determining said location of said game object or said player on said field based on said geographic information and said radio frequency identification tag data as well as based on said indication from said appropriate sensors that light has been obscured.

13. The system as recited in claim 9, wherein said appropriate light-emitting fibers are activated to give off light in such a manner as to provide an image on said field of footprints of said player entering or exiting said hot zone area.

14. A computer program product embodied in a computer readable storage medium, wherein the medium does not include a propagating signal, for improving accuracy and experience of a game comprising the programming steps of:

determining hot zone areas according to game rules;

sending signals to appropriate sensors to activate appropriate light-emitting fibers blended with grass on a field to indicate when one of a player and a game object entered or exited a hot zone area;

activating said appropriate light-emitting fibers to give off light;

receiving geographic information and radio frequency identification tag data from said game object or from said player; and determining a location of said game object or said player on said field based on said geographic information and said radio frequency identification tag data.

15. The computer program product as recited in claim 14 further comprising the programming step of:

receiving an indication from said appropriate sensors that light has been obscured.

16. The computer program product as recited in claim 15, wherein said signals are sent to said appropriate sensors that had light obscured at time one of said player and said game object entered or exited said hot zone area.

17. The computer program product as recited in claim 15 further comprising the programming step of:

determining said location of said game object or said player on said field based on said geographic information and said radio frequency identification tag data as well as based on said indication from said appropriate sensors that light has been obscured.

* * * * *